US011851801B2

(12) United States Patent
Huang et al.

(10) Patent No.: US 11,851,801 B2
(45) Date of Patent: Dec. 26, 2023

(54) AUTOMATIC ADDITIVE DISPENSING DEVICE

(71) Applicants: QINGDAO JIAONAN HAIER DRUM WASHING MACHINE CO., LTD., Shandong (CN); HAIER SMART HOME CO., LTD., Shandong (CN)

(72) Inventors: Tao Huang, Shandong (CN); Yuliang Jiang, Shandong (CN)

(73) Assignees: QINGDAO JIAONAN HAIER WASHING MACHINE CO., LTD., Shandong (CN); HAIER SMART HOME CO., LTD., Shandong (CN)

( * ) Notice: Subject to any disclaimer, the term of this patent is extended or adjusted under 35 U.S.C. 154(b) by 262 days.

(21) Appl. No.: 17/275,090

(22) PCT Filed: Sep. 9, 2019

(86) PCT No.: PCT/CN2019/104851
§ 371 (c)(1),
(2) Date: Mar. 10, 2021

(87) PCT Pub. No.: WO2020/052508
PCT Pub. Date: Mar. 19, 2020

(65) Prior Publication Data

US 2021/0254259 A1 Aug. 19, 2021

(30) Foreign Application Priority Data

Sep. 10, 2018 (CN) ..... 201811051916.4

(51) Int. Cl.
*D06F 39/02* (2006.01)
*D06F 33/37* (2020.01)
(Continued)

(52) U.S. Cl.
CPC ..... *D06F 39/022* (2013.01); *D06F 33/37* (2020.02); *D06F 39/088* (2013.01); *D06F 2105/42* (2020.02)

(58) Field of Classification Search
None
See application file for complete search history.

(56) References Cited

U.S. PATENT DOCUMENTS

2012/0240344 A1* 9/2012 Lv ..... D06F 39/022 68/17 R
2015/0238066 A1* 8/2015 Wang ..... A47L 15/4427 137/115.11

FOREIGN PATENT DOCUMENTS

CN 101666392 A 3/2010
CN 102409515 A 4/2012
(Continued)

OTHER PUBLICATIONS

International Search Report (PCT/ISA/210) and Written Opinion (PCT/ISA/237) dated Dec. 12, 2019, by the Chinese Patent Office as the International Searching Authority for International Application No. PCT/CN2019/104851.

*Primary Examiner* — Cristi J Tate-Sims
(74) *Attorney, Agent, or Firm* — BUCHANAN INGERSOLL & ROONEY PC

(57) ABSTRACT

An automatic additive dispensing device includes: a liquid additive storage box, a measuring chamber communicating with the storage box, a pumping unit for pumping the additive into the measuring chamber, and a flushing water passage communicating with the measuring chamber. The measuring chamber measures the amount of an additive entering the measuring chamber; the flushing water passage introduces water into the measuring chamber, and then the additive pumped into the measuring chamber is discharged. The measuring chamber is flushed; and may directly or
(Continued)

indirectly communicate with the liquid storage box. A one-way passage is arranged for flowing in a direction from the liquid storage box to the measuring chamber. By providing the simple one-way passage between the liquid storage box and the measuring chamber, flushing water can be prevented from being guided into the liquid storage box in the process of flushing the measuring chamber.

12 Claims, 3 Drawing Sheets

(51) Int. Cl.
*D06F 39/08* (2006.01)
*D06F 105/42* (2020.01)

(56) References Cited

FOREIGN PATENT DOCUMENTS

| | | | |
|---|---|---|---|
| CN | 106048985 | A | 10/2016 |
| EP | 1206594 | A1 | 5/2002 |

* cited by examiner

AUTOMATIC ADDITIVE DISPENSING DEVICE

TECHNICAL FIELD

The present disclosure relates to the field of washing equipment, and particularly relates to an automatic additive dispensing device.

BACKGROUND

In a traditional washing machine, a detergent used in a washing process is placed separately from the washing machine, and the washing machine is not provided with a detergent adding device, so the detergent cannot be added automatically. Through this structure, a fully automatic washing control process of the washing machine cannot be achieved. With the improvement of washing machine automation, most washing machines are configured as follows: a detergent case containing a detergent or/and softener is in communication with a water inlet pipeline, and the detergent or/and softener in the detergent case is flushed into a washing barrel by inflow water. However, in this structure, the detergent or/and softener need to be put into the detergent case every time before washing of clothes, and similarly, a fully automatic washing control process of the washing machine is not achieved.

There are a large number of patent applications related to automatic detergent dispensing devices at present. Chinese patent application No. CN97208723.0 discloses a detergent adding device for a washing machine, wherein a washing machine box is provided with an accommodating cavity matched with a bottle, and a conical through hole is formed in a bottom of the accommodating cavity; a vertical fixing sheet that fixes a detergent conduit pipe is fixed on the conical through hole; a body of the bottle is matched with the accommodating cavity; and a conical intake pipe is arranged at an opening of the bottle, a bottom of which is provided with an air vent. This structure cannot control the added amount of the detergent, and is easily damaged, thereby wasting the detergent.

Chinese patent application No. CN99101767.6 discloses a washing machine capable of automatically adding a liquid detergent, including: a washing drum, a detergent case, and a valve for opening and closing an intake channel, wherein the amount of detergent added into the washing drum from an intake hole in a bottom of the detergent case is controlled by the valve, and a sensor for detecting the amount of detergent is arranged in the detergent case. Through this structure, the undiluted detergent is directly discharged into the washing drum, which can damage clothes being washed.

Chinese patent application No. CN200610136059.9 discloses a detergent supply apparatus with a detergent case having a siphon unit for a washing machine, wherein a detergent is injected into the detergent case, and washing water is injected into the detergent case to dilute the detergent in the detergent case, and then the diluted detergent is discharged from the siphon unit into a washing drum. This apparatus solves the problem of damage to the clothes being washed caused by a concentrated detergent entering the washing drum directly, but cannot achieve automatic addition and precise control of the detergent.

The applicant's earlier Chinese patent application No. CN200910250314.6 discloses a washing method and washing machine for automatically adding a detergent by negative pressure. The washing machine comprises a water inlet, a detergent container and a washing tub, wherein two water inflowing passages, namely a main inflow water passage and a rinse water passage, are formed between the water inlet and the washing tub; a constant-volume container is arranged between the rinse water passage and the washing tub, and communicates with the detergent container. A venturi pipe is arranged in the main inflow water passage; due to the venturi effect, a thick main inflow water stream becomes narrower and a water inflowing velocity is accelerated, so that a relative vacuum area which communicates with the constant-volume container is formed at a rear side of an outlet of the venturi pipe, and negative pressure is generated in the constant-volume container to pump the detergent in the detergent container which communicates with the constant-volume container into the constant-volume container. However, a control valve is arranged at a position of the rinse water passage corresponding to the detergent container, and the control valve controls the closure between the corresponding constant-volume container and the detergent container simultaneously when controlling the communication of the passage, and vice versa. Although this structure can achieve precise control of the detergent, the additive control timing sequence is complicated and the cost is high due to the addition of the control valve structure.

The present disclosure is proposed in view of this.

SUMMARY

A technical problem to be solved by the present disclosure is to overcome the shortcomings of the prior art and provide an automatic additive dispensing device which is simple in structure, convenient to control, and low in cost.

To solve the above technical problem, a basic idea of a technical solution adopted by the present disclosure is as follows.

An automatic additive dispensing device includes:

a liquid storage box for storing a liquid additive therein;

a measuring chamber communicating with the liquid storage box, and used for measuring the amount of an additive entering the measuring chamber;

an additive pumping unit for pumping the additive in the liquid storage box into the measuring chamber;

a flushing water passage for introducing inflow water into the measuring chamber to discharge the additive pumped into the measuring chamber by the additive pumping unit and flush the measuring chamber;

wherein a one-way passage for flowing in a direction from the liquid storage box to the measuring chamber is arranged between the measuring chamber and the liquid storage box.

Further, a communicating liquid guiding pipeline is arranged between the measuring chamber and the liquid storage box, and a one-way valve for flowing in the direction from the liquid storage box to the measuring chamber is arranged in the liquid guiding pipeline.

Further, a shut-off structure that is open during contact of the measuring chamber and the liquid storage box and closed during separation of the measuring chamber and the liquid storage box is arranged between the measuring chamber and the liquid storage box.

Preferably, two liquid guiding pipelines that are movably separable are arranged between the measuring chamber and the liquid storage box, and the shut-off structure is arranged at connected end parts of the two liquid guiding pipelines, and the one-way valve for flowing in the direction from the liquid storage box to the measuring chamber is arranged in one of the liquid guiding pipelines.

Further, a liquid guiding pipe is arranged between the measuring chamber and the liquid storage box, wherein one end of the liquid guiding pipe communicates with the measuring chamber; the liquid storage box is provided with a mounting hole in a position corresponding to the other end of the liquid guiding pipe; a shut-off valve for controlling the interior of the liquid storage box to communicate with and to be isolated from the outside is arranged in the mounting hole; a push rod is arranged at the other end part, corresponding to the liquid storage box, of the liquid guiding pipe; and when the liquid storage box is connected with the liquid guiding pipe, the end part of the liquid guiding pipe extends into the mounting hole to open the shut-off valve to achieve communication between the measuring chamber and the liquid storage box.

Further, the shut-off valve includes a valve chamber and a liquid outlet arranged in the mounting hole; the valve chamber communicates with the liquid outlet and the interior of the liquid storage box, respectively; the valve chamber is internally provided with a spring and a valve element that blocks the liquid outlet by reset movement of the spring; when the liquid storage box is connected with the liquid guiding pipe, the push rod pushes the valve element to separate from the liquid outlet to achieve communication of the liquid guiding pipe with the valve chamber and the interior of the liquid storage box; and when the liquid storage box is separated from the liquid guiding pipe, the valve element blocks the liquid outlet by reset movement of the spring to achieve closure between the interior of the liquid storage box and the outside.

Preferably, the valve chamber communicates with the interior of the liquid storage box through a suction pipe, one end of the suction pipe communicates with the valve chamber, and the other end of the suction pipe extends to a lowest position inside the liquid storage box.

Further, a one-way valve is arranged in the liquid guiding pipe.

Further, the measuring chamber is a constant-volume container with a function of measuring the amount of the additive; or the measuring chamber is provided with a liquid measuring valve for measuring the amount of the additive.

Further, the additive pumping unit includes a venturi pipe, which is arranged on a main inflow water passage, and a negative pressure pipeline is arranged between a negative pressure port of the venturi pipe and the measuring chamber.

Preferably, the negative pressure pipeline is provided with a floating ball valve.

Further, the flushing water passage includes:

an inflow water passage for controlling inflow water to be guided into the measuring chamber; and an outflow water passage for discharging the additive pumped into the measuring chamber by the additive pumping unit and flushing water.

Preferably, the outflow water passage is provided with a one-way valve.

Further, a control valve is further arranged on the main inflow water passage at the rear of the venturi pipe; and in a closed state of the control valve, inflow water from the main inflow water passage flows through the negative pressure pipeline to the measuring chamber to form the inflow water passage.

By adopting the above technical solution, the present disclosure achieves the following technical effects compared with the prior art.

According to the present disclosure, a great improvement is made in the field of automatic additive dispensing, and precise and automatic additive addition is achieved. After the additive is quantitatively pumped by the additive pumping unit, the quantitative additive is discharged by means of the flushing water passage to completely implement automatic addition. The automatic additive dispensing device is simple in structure, not only can prevent the phenomenon that the amount of the additive manually added is too small or too great, but also saves the cost caused by using other complicated structures for automatically adding the additive, and therefore alleviates the pollution caused by discharging washing water to the environment, achieves an automated washing process, and improves washing efficiency. In addition, by providing the simple one-way passage between the liquid storage box and the measuring chamber, flushing water can be prevented from being guided into the liquid storage box in the process of flushing the measuring chamber, the structure is simple, the control timing sequence of automatic dispensing is simplified, and costs are saved.

Specific embodiments of the present disclosure are further described in detail below in conjunction with the accompanying drawings.

BRIEF DESCRIPTION OF THE DRAWINGS

The drawings as part of the present disclosure are used to provide further understanding of the present disclosure. The illustrative embodiments of the present disclosure and description thereof are used for explaining the present disclosure, but do not improperly limit the present disclosure. Obviously, the drawings described below are merely some embodiments, and those of ordinary skill in the art can obtain other drawings according to these drawings without creative work. In the drawings.

Figure 1:
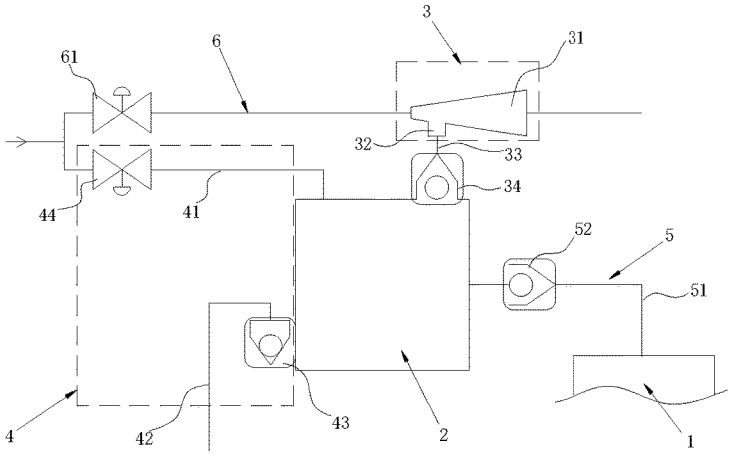
FIG. 1 is a schematic diagram of a connecting structure of an automatic additive dispensing device of the present disclosure.

It should be noted that these drawings and text descriptions are not intended to limit the scope of conception of the present disclosure in any way, but are intended to explain the concepts of the present disclosure for those skilled in the art with reference to specific embodiments.

DETAILED DESCRIPTION

To make the objects, technical solutions and advantages of the embodiments of the present disclosure clearer, the technical solutions in the embodiments will be described clearly and completely with reference to the drawings in the embodiments of the present disclosure. The following embodiments are used for illustrating the present disclosure, but not limiting the scope of the present disclosure.

In description of the present disclosure, it should be noted that orientation or location relations denoted by the terms "upper", "lower", "front", "back", "left", "right", "vertical", "inner", and "outer" are orientation or location relations based on illustration in the drawings, are only intended to conveniently describe the present disclosure and simplify description, instead of indicating or implying the denoted devices or elements necessarily have specific orientations and are constructed and operated in specific orientations, and thus cannot be understood as limiting the present disclosure.

In description of the present disclosure, it should be noted that unless otherwise explicitly specified and defined, the terms "installation", "connected" and "connection" should be construed broadly, for example, the connection may denote fixed connection, and may also denote detachable connection, or integrated connection; and may denote direct connection, and may also denote indirect connection via an intermediate medium. For those of ordinary skill in the art, the specific meanings of the above terms in the present disclosure may be construed according to specific conditions.

As shown in FIGS. 1 to 4, an automatic additive dispensing device of the present disclosure includes a liquid storage box 1 for storing a liquid additive, a measuring chamber 2 communicating with the liquid storage box 1, an additive pumping unit 3 for pumping the additive in the liquid storage box 1 to the measuring chamber 2, and a flushing water passage 4 communicating with the measuring chamber 2, wherein the measuring chamber 2 measures the amount of an additive entering the measuring chamber; the flushing water passage 4 introduces inflow water into the measuring chamber 2, and then the additive pumped into the measuring chamber 2 by the additive pumping unit 3 is discharged, and the measuring chamber 2 is flushed; and the measuring chamber 2 may directly or indirectly communicate with the liquid storage box 1, and a one-way passage 5 for flowing in a direction from the liquid storage box 1 to the measuring chamber 2 is arranged between the measuring chamber 2 and the liquid storage box 1.

Specifically, a communicating liquid guiding pipeline 51 is arranged between the measuring chamber 2 and the liquid storage box 1, and a one-way valve 52 for flowing in the direction from the liquid storage box 1 to the measuring chamber 2 is arranged in the liquid guiding pipeline 51.

Embodiment 1

The measuring chamber 2 in this embodiment is a constant-volume container with a function of measuring the amount of the additive, that is, the volume of the measuring chamber 2 is constant. After the measuring chamber 2 is full of the additive pumped by the additive pumping unit 3, the amount of the pumped additive is determined. After the measuring chamber 2 is full of the additive pumped once or multiple times, and the measuring chamber 2 is flushed by the flushing water passage 4, the additive is precisely dispensed.

Alternatively, the measuring chamber 2 is provided with a liquid measuring valve (not shown in the figure) for measuring the amount of the additive, which may be generally an impeller flow valve. When the additive pumped by the additive pumping unit 3 flows through the liquid measuring valve, the amount of the pumped additive can be determined.

Embodiment 2

In this embodiment, to save costs, the additive pumping unit 3 includes a venturi pipe 31. The venturi pipe 31 is arranged on a main inflow water passage 6, and a negative pressure pipeline 33 is arranged between a negative pressure port 32 of the venturi pipe and the measuring chamber 2. A negative pressure is generated at the negative pressure port 32 of the venturi pipe by using inflow water in the main inflow water passage 6 to pump air in the measuring chamber 2, thereby pumping the additive in the liquid storage box 1 into the measuring chamber 2.

Preferably, the negative pressure pipeline 33 is provided with a floating ball valve 34. After the measuring chamber 2 is full of the pumped additive, a floating ball in the floating ball valve 34 rises to close the negative pressure pipeline 33, and at that time, the additive in the liquid storage box 1 is no longer pumped.

In the present disclosure, the flushing water passage 4 includes:

an inflow water passage 41 for controlling inflow water to be guided into the measuring chamber 2; and an outflow water passage 42 for discharging the additive pumped into the measuring chamber 2 by the additive pumping unit 3 and flushing water.

Preferably, the outflow water passage 42 is provided with a one-way valve 43. In the process of pumping the additive into the measuring chamber 2 by the additive pumping unit 3, the one-way valve 43 is closed. When the flushing water passage 4 starts to flush the measuring chamber, the additive and the flushing water can be discharged from the one-way valve 43. The one-way valve may be a ball valve. When the measuring chamber 2 is subjected to negative pressure pumping, the ball valve is sealed by the negative pressure. When the flushing water is discharged, the ball valve can be reopened.

Figure 2:
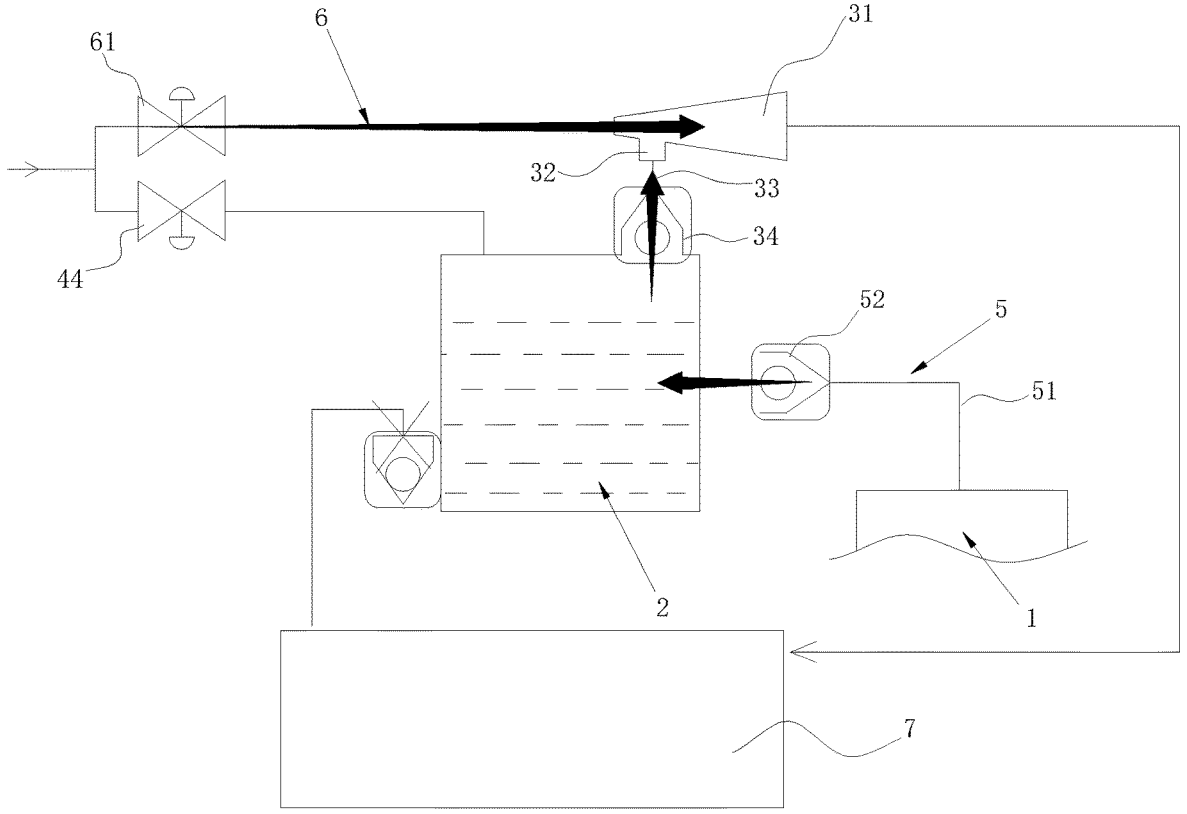
FIG. 2 is a schematic diagram of pumping an additive by an additive pumping unit of the present disclosure.

Specifically, the main inflow water passage 6 is further provided with a main inlet valve 61 for controlling inflow water of the main inflow water passage, and the inflow water passage 41 is further provided with a flushing inlet valve 44 for controlling flushing inflow water. As shown in FIG. 2, which is a schematic diagram of pumping the additive by the additive pumping unit, the main inlet valve 61 is opened, inflow water enters the main inflow water passage 6, and can directly or indirectly enter a washing container 7 of washing equipment; and when the inflow water passes through the venturi pipe 31, a negative pressure is generated at the negative pressure port 32 of the venturi pipe to pump air in the measuring chamber 2 so that the additive in the liquid storage box 1 is pumped into the measuring chamber 2 through the liquid guiding pipeline 51. In the additive pumping process, the one-way valve 52 in the liquid guiding pipeline 51 allows the additive to pass, and when the pumped additive reaches a preset value of the measuring chamber, the floating ball valve 34 is closed, and the negative pressure generated by the venturi pipe 31 no longer works.

Figure 3:
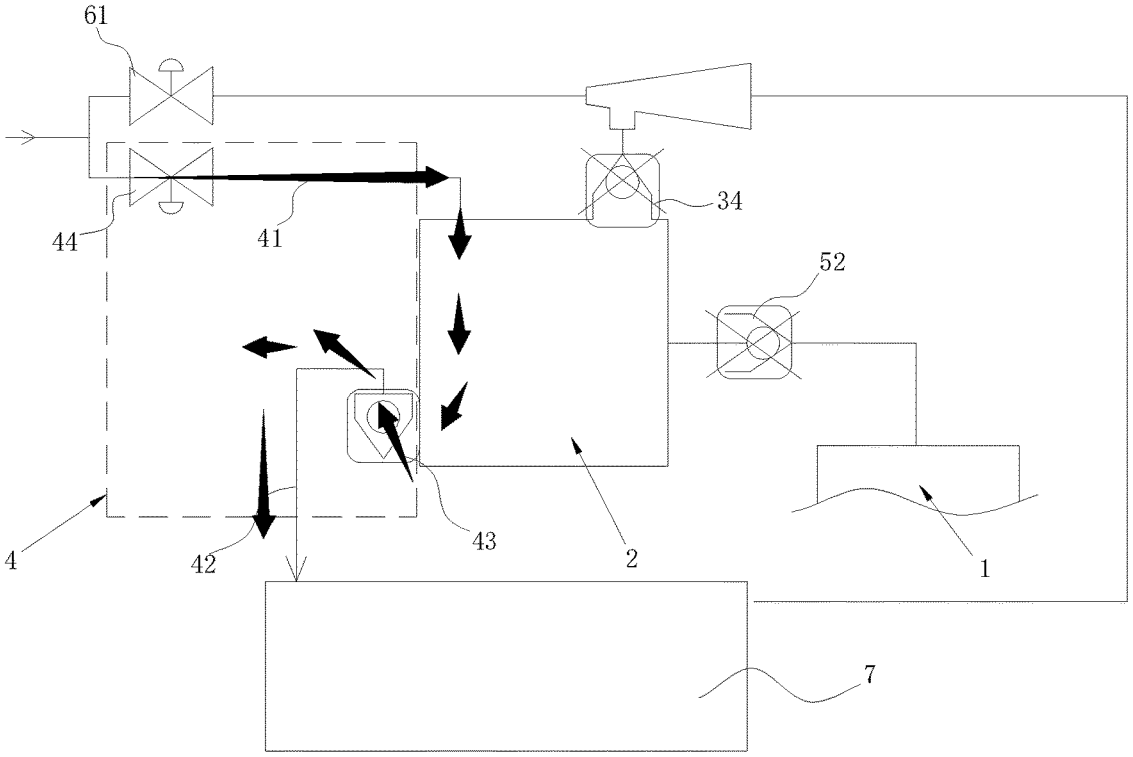
FIG. 3 is a schematic diagram of flushing the additive in a measuring chamber by a flushing water passage of the present disclosure.

As shown in FIG. 3, which is a schematic diagram of flushing the additive in the measuring chamber by the flushing water passage, the flushing inlet valve 44 is opened, the flushing inflow water passes through the inflow water passage 41 to enter the measuring chamber 2, and the one-way valve 43 is opened through water discharged from the outflow water passage 42. In this process, the one-way passage 5 between the measuring chamber 2 and the liquid storage box 1 can prevent the inflow water from flowing back into the liquid storage box 1. The water discharged from the outflow water passage 42 can directly or indirectly enter the washing container 7 of the washing equipment, for example, the inflow water directly enters an outer barrel of a washing machine or indirectly enters the outer barrel through a detergent case of the washing machine.

Embodiment 3

Figure 4:
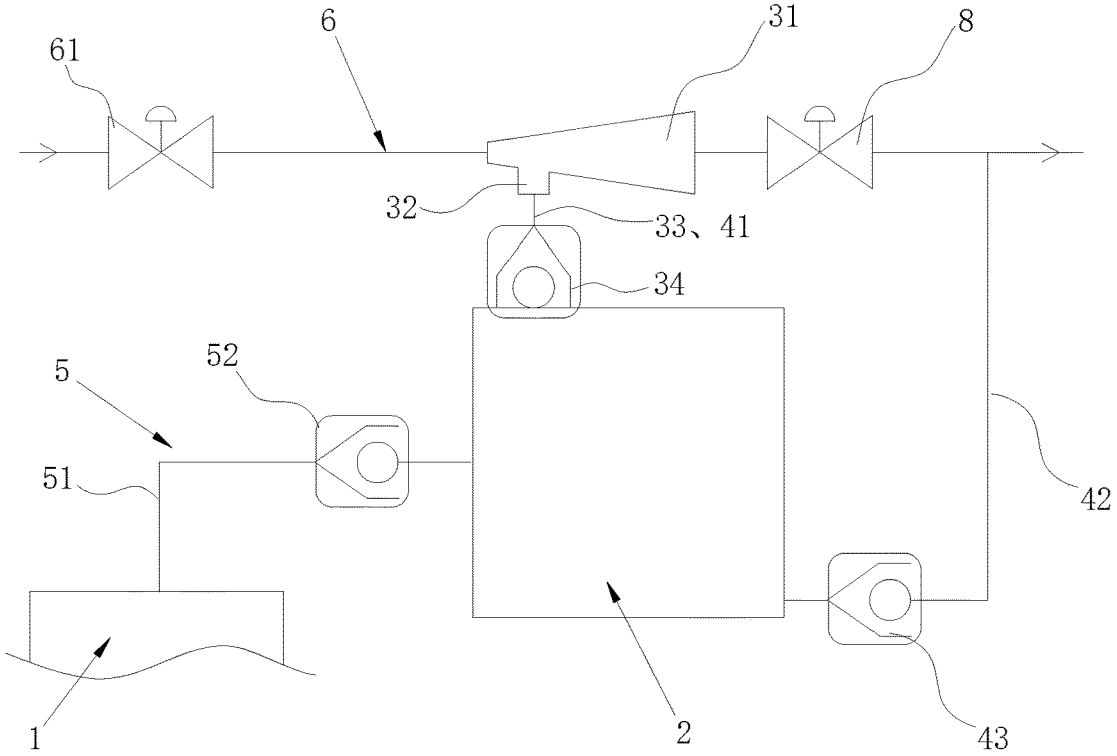
FIG. 4 is a schematic diagram of a connecting structure of another automatic additive dispensing device of the present disclosure.

As shown in FIG. 4, this embodiment differs from the above embodiments in that in this embodiment, the negative pressure pipeline 33 is used as part of the inflow water passage 41, and a control valve 8 is arranged on the main inflow water passage 6 at the rear of the venturi pipe 31; inflow water enters the main inflow water passage 6, and passes through the venturi pipe 31 in an open state of the control valve 8, and the negative pressure pipeline 33 performs negative pressure pumping to pump the additive; and after the amount of the pumped additive reaches a set condition, the control valve 8 is closed, and at that time, the inflow water from the main inflow water passage 6 flows through the negative pressure pipeline 33 to the measuring chamber 2 to form the inflow water passage 41.

Embodiment 4

Figure 5:
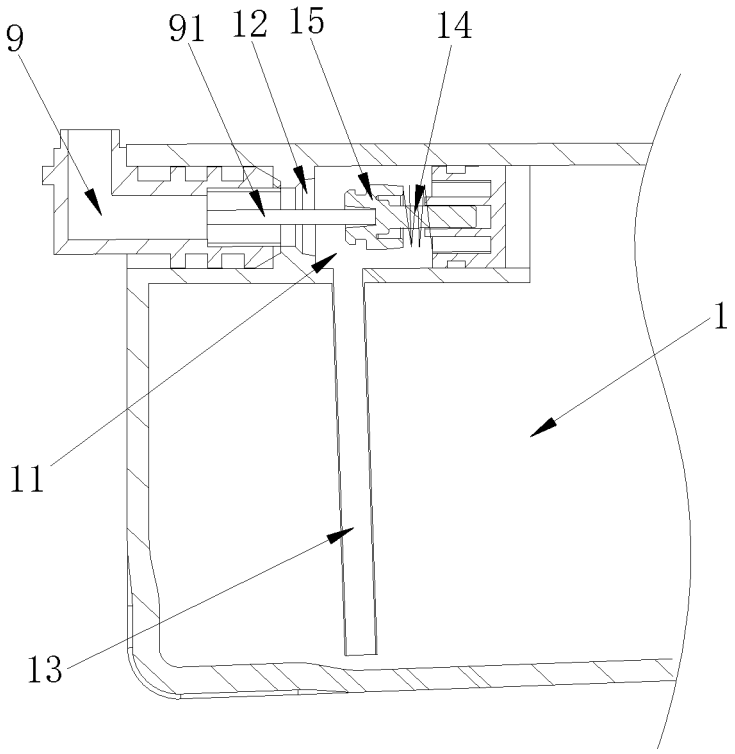
FIG. 5 is a structural schematic diagram of communication between a liquid storage box and a measuring chamber of the present disclosure.

As shown in FIG. 5, in the automatic additive dispensing device of this embodiment, the measuring chamber 2 indirectly communicates with the liquid storage box 1, and may be separated and disconnected from each other, and a shut-off structure that is opened during contact of the measuring chamber 2 and the liquid storage box 1 and closed during separation the measuring chamber 2 and the liquid storage box 1 is arranged between the measuring chamber 2 and the liquid storage box 1.

Two liquid guiding pipelines 51 that are movably separable are arranged between the measuring chamber 2 and the liquid storage box 1, and the shut-off structure is arranged at connected end parts of the two liquid guiding pipelines, and the one-way valve 52 for flowing in the direction from the liquid storage box 1 to the measuring chamber 2 is arranged in one of the liquid guiding pipelines 51. After the measuring chamber 2 communicates with the liquid storage box 1, the one-way valve 52 can prohibit flowing from the measuring chamber 2 to the liquid storage box 1.

A general design is that the measuring chamber 2 is of a fixedly installed structure, and the liquid storage box 1 is of a movably detachable structure, such as a pull-out structure or a structure that the liquid storage box 1 can be taken out from an opening in a slot, and communicates with the measuring chamber by pushing or pressing assembly. Thus, the shut-off structure is provided to prevent the liquid additive in the liquid storage box 1 from overflowing from the communication position when the liquid storage box is taken out.

A solution selected in this embodiment is that a liquid guiding pipe 9 is arranged between the measuring chamber 2 and the liquid storage box 1, and a one-way valve (not shown in the figure) is arranged in the liquid guiding pipe 9, wherein one end of the liquid guiding pipe 9 communicates with the measuring chamber 2; the liquid storage box 1 is provided with a mounting hole (not shown in the figure) at a position corresponding to the other end of the liquid guiding pipe 9; the mounting hole is internally provided with a shut-off valve for controlling the interior of the liquid storage box 1 to communicate with and to be isolated from the outside; a push rod 91 is arranged at the other end part, corresponding to the liquid storage box 1, of the liquid guiding pipe 9; and when the liquid storage box 1 is connected with the liquid guiding pipe 9, the end part of the liquid guiding pipe 9 extends into the mounting hole to open the shut-off valve to achieve communication between the measuring chamber 2 and the liquid storage box 1.

Further, the shut-off valve includes a valve chamber 11 and a liquid outlet 12 arranged in the mounting hole; the valve chamber 11 communicates with the liquid outlet 12 and the interior of the liquid storage box 1, respectively; the valve chamber 11 is internally provided with a spring 14 and a valve element 15 that blocks the liquid outlet 12 by reset movement of the spring 14; when the liquid storage box 1 is connected with the liquid guiding pipe 9, the push rod 91 pushes the valve element 15 to separate from the liquid outlet 12 to achieve communication of the liquid guiding pipe 9 with the valve chamber 11 and the interior of the liquid storage box 1; and when the liquid storage box is separated from the liquid guiding pipe 9, the valve element 15 blocks the liquid outlet 12 by reset movement of the spring 14 to achieve closure between the interior of the liquid storage box 1 and the outside.

Preferably, the valve chamber 11 communicates with the interior of the liquid storage box 1 through a suction pipe 13, one end of the suction pipe 13 communicates with the valve chamber 11, and the other end of the suction pipe 13 extends to a lowest position inside the liquid storage box 1.

The above description only involves preferred embodiments of the present disclosure, and does not limit the present disclosure in any form. Although the present disclosure has been disclosed above with the preferred embodiments, the present disclosure is not limited thereto. Any persons familiar with the patent can use the suggested technical contents described above to make some alterations or modifications to produce equivalent embodiments with equivalent variations without departing from the technical solutions of the present disclosure. All simple alterations, equivalent variations, and modifications made to the above embodiments according to the technical essence of the present disclosure without departing from the contents of the technical solutions of the present disclosure still fall within the scope of the solutions of the present disclosure.

The invention claimed is:

1. An automatic additive dispensing device, comprising:

a liquid storage box for storing a liquid additive therein;

a measuring chamber communicating with the liquid storage box for measuring an amount of the liquid additive entering the measuring chamber;

an additive pumping unit for pumping the liquid additive in the liquid storage box into the measuring chamber;

a flushing water passage for introducing inflow water into the measuring chamber to discharge the liquid additive pumped into the measuring chamber by the additive pumping unit and flushing the measuring chamber; wherein a one-way passage for flowing in a direction from the liquid storage box to the measuring chamber is arranged between the measuring chamber and the liquid storage box, a shut-off structure arranged between the measuring chamber and the liquid storage box, the shut-off structure is open when the measuring chamber and the liquid storage box are in contact and the shut-off structure is closed when the measuring chamber and the liquid storage box are separated, two liquid guiding pipelines that are movably separable arranged between the measuring chamber and the liquid storage box, and the shut-off structure arranged at connected end parts of the two liquid guiding pipelines, and a one-way valve for flowing in the direction from the liquid storage box to the measuring chamber arranged in one of the liquid guiding pipelines, a liquid guiding pipe arranged between the measuring chamber and the liquid storage box, one end of the liquid guiding pipe communicates with the measuring chamber; the liquid storage box provided with a mounting hole in a position corresponding to an other end of the liquid guiding pipe; the mounting hole is internally provided with a shut-off valve for controlling the interior of the liquid storage box to communicate with and to be isolated from the outside; a push rod is arranged at an other end part, corresponding to the liquid storage box, of the liquid guiding pipe; and when the liquid storage box is connected with the liquid guiding pipe, the end part of the liquid guiding pipe extends into the mounting hole to open the shut-off valve to make the measuring chamber and the liquid storage box communicated.

2. The automatic additive dispensing device according to claim 1, wherein the shut-off valve comprises a valve chamber and a liquid outlet which are arranged in the mounting hole; the valve chamber communicates with the liquid outlet and an interior of the liquid storage box, respectively; the valve chamber is internally provided with a spring and a valve element that blocks the liquid outlet by reset movement of the spring; when the liquid storage box is connected with the liquid guiding pipe, the push rod pushes the valve element to separate from the liquid outlet make the liquid guiding pipe communicate with the valve chamber and the interior of the liquid storage box; and when the liquid storage box is separated from the liquid guiding pipe, the valve element blocks the liquid outlet by reset movement of the spring to achieve cut-off the interior of the liquid storage box and an outside of the liquid storage box.

3. The automatic additive dispensing device according to claim 2, wherein the valve chamber communicates with the interior of the liquid storage box through a suction pipe, one end of the suction pipe communicating with the valve chamber, and an other end of the suction pipe extending to a lowest position of the interior of the liquid storage box.

4. The automatic additive dispensing device according to claim 1, wherein a one-way valve is arranged in the liquid guiding pipe.

5. The automatic additive dispensing device according to claim 1, wherein the measuring chamber is a constant-volume container for measuring the amount of the liquid additive, or the measuring chamber is provided with a liquid measuring valve for measuring the amount of the liquid additive.

6. The automatic additive dispensing device according to claim 1, wherein the additive pumping unit comprises a venturi pipe, the venture pipe is arranged on a main inflow water passage, and a negative pressure pipeline is arranged between a negative pressure port of the venturi pipe and the measuring chamber.

7. The automatic additive dispensing device according to claim 6, wherein the negative pressure pipeline is provided with a floating ball valve.

8. The automatic additive dispensing device according to claim 6, wherein the flushing water passage comprises:

an inflow water passage for introducing the inflow water into the measuring chamber; and an outflow water passage for discharging the liquid additive pumped into the measuring chamber by the additive pumping unit and flushing water.

9. The automatic additive dispensing device according to claim 8, wherein a control valve is arranged on the main inflow water passage at rear of the venturi pipe; and in a closed state of the control valve, the inflow water from the main inflow water passage flows through the negative pressure pipeline to the measuring chamber to form the inflow water passage.

10. The automatic additive dispensing device according to claim 2, wherein a one-way valve is arranged in the liquid guiding pipe.

11. The automatic additive dispensing device according to claim 3, wherein a one-way valve is arranged in the liquid guiding pipe.

12. The automatic additive dispensing device according to claim 7, wherein the flushing water passage comprises:

an inflow water passage for introducing the inflow water into the measuring chamber; and an outflow water passage for discharging the liquid additive pumped into the measuring chamber by the additive pumping unit and flushing water.

* * * * *